US010467839B2

(12) United States Patent
Dennis

(10) Patent No.: US 10,467,839 B2
(45) Date of Patent: Nov. 5, 2019

(54) SYSTEMS AND METHODS FOR COIN COUNTING

(71) Applicant: CoinedBox, Inc., Santa Monica, CA (US)

(72) Inventor: Michael David Dennis, Santa Monica, CA (US)

(73) Assignee: CoinedBox, Inc., Santa Monica, CA (US)

( * ) Notice: Subject to any disclaimer, the term of this patent is extended or adjusted under 35 U.S.C. 154(b) by 0 days.

(21) Appl. No.: 14/919,059

(22) Filed: Oct. 21, 2015

(65) Prior Publication Data

US 2016/0148454 A1 May 26, 2016

Related U.S. Application Data

(60) Provisional application No. 62/066,829, filed on Oct. 21, 2014.

(51) Int. Cl.
*G07D 5/02* (2006.01)
*G07D 3/14* (2006.01)

(52) U.S. Cl.
CPC ..... *G07D 3/14* (2013.01); *G07D 5/02* (2013.01)

(58) Field of Classification Search
CPC ..... G07D 5/00; G07D 5/005; G07D 5/08; G07D 5/02; G07D 5/04; G07D 13/00; G07D 11/00; G07D 11/0003; G07D 11/0006; G07D 11/0009; G07D 11/0012; G07D 11/0021; G07D 11/0024; G07D 11/0045; G07D 11/0051; G07D 11/0054; G07D 11/0057; G07D 11/006; G07D 11/0063; G07D 11/0066; G07D 11/0069; G07D 11/0072; G07D 11/0075; G07D 11/0084; G07F 3/02; G07F 3/022; G07F 19/00; G07F 19/20; G07F 19/201; G07F 19/205; G07F 19/207; G07F 19/209; G06Q 20/1085
USPC ..... 194/302, 206, 207, 334, 335; 209/534; 235/379; 382/135, 136; 73/163; 702/137, 155–157
See application file for complete search history.

(56) References Cited

U.S. PATENT DOCUMENTS 4,483,431 A * 11/1984 Pratt ..... G07D 5/08 194/317
5,180,046 A * 1/1993 Hutton ..... G07D 5/02 194/319
5,201,396 A * 4/1993 Chalabian ..... G07D 5/02 194/217
5,788,046 A * 8/1998 Lamah ..... G07D 5/08 194/317

(Continued)

FOREIGN PATENT DOCUMENTS

GB 2096812 A * 2/1981 ..... G07D 5/08

*Primary Examiner* — Jeffrey A Shapiro
(74) *Attorney, Agent, or Firm* — KPPB LLP

(57) ABSTRACT

An object of the present invention is to provide a coin detection apparatus that includes a coin path and a light emitting diode (LED) sensor array positioned within the coin path and configured to transmit light beams within the coin path in order to detect characteristics of coins travelling through the coin path based on information from the LED sensor array and transmit data regarding a coin type based on the detected characteristics of the coin to an external application.

14 Claims, 18 Drawing Sheets

(56) References Cited

U.S. PATENT DOCUMENTS 6,026,946 A * 2/2000 McCarty, Jr. ..... G07D 5/02 194/317
6,142,285 A * 11/2000 Panzeri ..... G07D 5/005 194/328
6,311,165 B1 * 10/2001 Coutts ..... G06Q 20/1085 235/379
6,412,620 B1 * 7/2002 Imura ..... G06K 9/00 194/317
7,810,729 B2 10/2010 Morley, Jr. et al.
7,896,248 B2 3/2011 Morley et al.
7,918,394 B1 4/2011 Morley, Jr. et al.
8,474,593 B2 * 7/2013 String ..... G07D 5/02 194/334
8,584,946 B2 11/2013 Morley, Jr. et al.
8,622,191 B2 * 1/2014 Leibu ..... G07D 5/08 194/332
9,218,517 B2 12/2015 Morley, Jr.
9,747,474 B2 8/2017 Morley, Jr.
2003/0150688 A1 * 8/2003 Martin ..... G07D 3/06 194/317
2010/0042861 A1 * 2/2010 Lee ..... G06F 1/3215 713/340
2010/0108762 A1 5/2010 Morley et al.
2010/0294617 A1 * 11/2010 Straumann ..... G07D 5/00 194/302
2010/0314446 A1 12/2010 Morley et al.
2011/0125316 A1 * 5/2011 Lewis ..... G07D 1/02 700/232
2011/0180601 A1 7/2011 Morley et al.
2012/0305645 A1 12/2012 Morley et al.
2013/0128223 A1 * 5/2013 Wood ..... A61B 5/0077 351/206
2013/0163688 A1 * 6/2013 Calvin ..... G01D 21/00 375/272
2013/0202184 A1 * 8/2013 Grove ..... G07D 5/00 382/136
2014/0076964 A1 3/2014 Morley et al.
2014/0332588 A1 11/2014 Morley, Jr.
2015/0262446 A1 * 9/2015 Taylor ..... G07D 5/00 194/302
2016/0063789 A1 * 3/2016 Taylor ..... G07D 5/00 194/320
2017/0351883 A1 12/2017 Morley, Jr.

* cited by examiner

SYSTEMS AND METHODS FOR COIN COUNTING

CROSS REFERENCE TO RELATED APPLICATIONS

This application claims the benefit of U.S. Provisional Patent Application No. 62/066,829 filed on Oct. 21, 2014, the disclosure of which is hereby incorporated by reference in its entirety.

FIELD OF INVENTION

The present invention relates to methods and systems for coin detection and, in particular, to identifying a denomination of a coin using light information obtained from a sensor array that transmits light beams across a path of the coin as it travels through the coin detection apparatus.

BACKGROUND

Coin counters are well known in the prior art and are used by both consumers and commercial enterprises (e.g., banks) to quickly count large volumes of coins, which could otherwise be a tedious and time consuming task if done manually without the use of a machine. Many of the existing coin counters typically utilize a "chutes" design to identify coins whereby the coins are sorted into different categories (e.g., penny, nickel, dime, quarter, dollar) based on the coin falling into a particular "coin path" or "chute" within the coin detection apparatus. In particular, each coin-path within the counter is typically designed to allow only for a specific size of coin to enter the path, and each path may also include a sensor that notifies the counter anytime a coin moves through the particular path. Based on which of the particular sensors are being triggered, the coin counter may then add an appropriate amount to the current coin monetary count. Due to the extensive variety of coins and coin denominations currently in circulation throughout the world and/or new coins that are continuously being issued by many different currency issuers, the 'chutes' design presents significant limitations with respect to many coin counters.

SUMMARY OF THE INVENTION

In accordance with embodiments of the present invention, methods and systems for coin detection using sensor information about the characteristics of coins are described.

An object of the present invention is to provide a coin detection apparatus that includes a coin path; a network interface; and a light emitting diode (LED) sensor array positioned within the coin path and configured to transmit light beams within the coin path in order to detect characteristics of coins travelling through the coin path; and a processor configured to execute computer instructions, where the computer instructions direct the processor to detect characteristics of a coin travelling through the coin path based on information from the LED sensor array and transmit, using the network interface, data regarding a coin type based on the detected characteristics of the coin to an external application.

In a further embodiment, the LED sensor array includes several LEDs that each transmit a light beam to a corresponding light detector photodiode.

In yet a another embodiment, detecting the characteristics of the coin includes detecting a size of coin by determining which of the light beams of the plurality of LEDs are blocked by a coin travelling through the coin path.

In still another embodiment again, transmitting data regarding the coin type includes transmitting an audio frequency to an external device.

In another embodiment again, the coin path is sloped at a non-zero angle.

In still another embodiment, the coin path includes shock absorbent material that absorbs an impact of a coin moving through the coin path.

In yet another embodiment again, the data is transmitted using a wireless communication channel.

In a further embodiment again, the data is transmitted to an input port of a user device selected from the group consisting of an auxiliary port, a microphone port, a charging input, and a data insert.

In yet a further embodiment again, the data is transmitted to an external software application executing on a device.

In another embodiment again, the software application converts the data to a coin type.

In still another embodiment, the apparatus receives power from an external device.

Another embodiment of the method of identifying a coin using an array of light beams, includes receiving a coin within a coin path, transmitting several light beams within the coin path, detecting an interference of a set of light beams within the several light beams, and identifying a coin type based on the set of light beams;

In a further embodiment of the method of the invention, also includes transmitting data regarding the coin type to an external device.

In another embodiment again, the plurality of light beams are transmitted using a sensor array of light emitting diodes (LED) that each transmit a light beam to a corresponding light detector photodiode.

In a further embodiment of the method of the invention, transmitting data regarding the coin type includes transmitting an audio frequency to an external device.

In yet a further embodiment again, the coin path is sloped at a non-zero angle.

In still another embodiment of the method again, the coin path includes shock absorbent material that absorbs an impact of a coin moving through the coin path.

In still yet another embodiment of the method again, the data is transmitted using a wireless communication channel.

In another embodiment of the invention again, the data is transmitted to an input port of a user device selected from the group consisting of an auxiliary port, a microphone port, a charging input, and a data insert.

In yet still another embodiment of the invention again, the data is transmitted to an external software application executing on a device.

DETAILED DESCRIPTION

Figure 1:
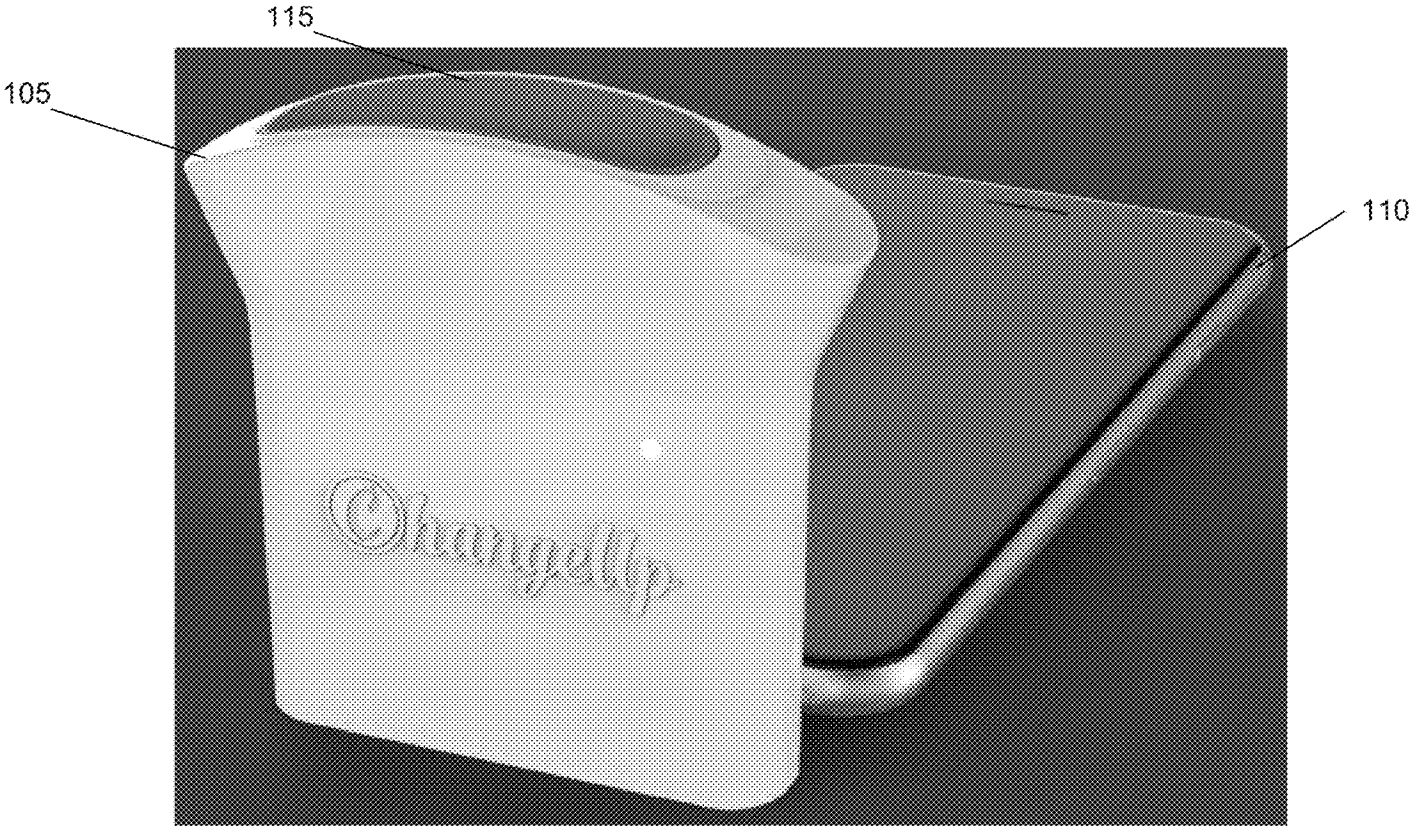
FIG. 1 illustrates an example of a coin detection apparatus that communicates with a mobile device in accordance with an embodiment of the invention.

Many existing coin counters are typically stand-alone apparatuses that count coins and/or paper money and provide a user with a monetary value for the amount being counted. As described above, in order to identify the type of coins being counted, many existing coin-counters typically utilize the "chutes" design that uses different coin paths to categorize coins for coin counting. Thus, existing coin counters are often bulky contraptions given that their designs need to accommodate many different coin chutes as needed for the variety of different coin denominations of a currency. Furthermore, each of these chutes within the coin detection apparatus often require a significant number of moving parts and/or hardware elements to achieve their functionalities (for example, each chute needs one or more sensors to detect coins moving through the chute along with the wiring to communicate with the counters that track the coin counting). Furthermore, as described above, existing coin counters are typically unable to accommodate many different coin denominations that may be issued by many different currency issuers (and/or new coins) since this would entail designing a large number of chutes and/or being able to add new chutes to an existing apparatus.

Thus, many embodiments of the invention provide a significantly more compact, streamlined, and resource efficient design for coin detection that is designed with one or more sensors that are able to detect the size and shape of a coin as the coin moves through a coin path within the coin detection apparatus for use in coin counting. The coin detection design may be used to detect coin types within a variety of different types of apparatuses, including coin counters, vending machines, parking meters, laundry machines, among any other type of device that accepts coins and/or needs to identify a denomination of a coin. Thus, although many of the embodiments that are described below are in relation for use within coin counters, the coin detection designs may be used within any of a variety of different types of devices that may benefit from being able to identify coin denominations.

Furthermore, unlike existing stand-alone coin counters that generally are limited to counting coins and displaying a corresponding monetary value for the counted amount, many embodiments of the coin detection apparatus communicate the coin counting data with one or more external user devices (e.g., smartphones) and/or software applications executing on these devices. The software application may provide many different functionalities and be used for a variety of different purposes, including tracking the coins being counted and/or managing user accounts as related to their ongoing coin counting activities (e.g., update an account that tracks a user's coin collection), communicating with one or more bank accounts of the user, among various other functions.

In many embodiments, the coin detection apparatus may identify a type of coin passing through a coin path using light information obtained from a light source. In particular, in many embodiments, the coin detection apparatus may obtain light information from a sensor array of light emitting diodes (LEDs) and corresponding photodiodes. The light information from the LED sensor array may be used to determine the size and shape of the coin as it travels through the apparatus. In certain embodiments, the sensor array of LED light beams are paired with photodiodes positioned at an opposite end, across a coin path through which the coins travel within the apparatus, and based on the light interference pattern of the various light beams as coins travel through the coin path, the apparatus may determine the size and/or shape of the coins.

In many embodiments, a microcontroller within the coin detection apparatus may determine how much light is blocked or revealed as a coin moves through a set of light beams being transmitted by the sensor array of LEDs. In certain embodiments, the array of LED light beams and photodiodes are positioned such that the coin detection apparatus is able to determine the diameter and/or thickness of a coin passing through based on a determination of which set of light beams in the sensor array of LEDs were blocked as the coin traveled through the coin path.

Furthermore, in order to increase the accuracy by which the coins are identified based on the light pattern information obtained from the LED sensor array, the coin path through which the coins travel within the apparatus may be sloped (i.e., angled) and/or include certain shock absorbent materials that minimizes the potential for the coins bouncing as the coins travel past the LED sensor array of the apparatus. By minimizing, and possibly eliminating, the potential for the coins bouncing, the apparatus is able to reduce the potential noise factor that would otherwise be present in the light patterns being analyzed in order to identify coin types.

In many embodiments, given that the coin detection apparatus identifies coin types based on detecting the size and shape of coins using light sensors, the coin detection apparatus may be programmed to recognize any of a variety of coins issued by many different currency issuers and/or coins of any given size, shape, and/or other identifiable properties. In particular, unlike the "chutes" of prior art designs that set a finite set of fixed coins sizes, using an LED sensor array to detect coins may allow the coin detection apparatus to recognize any of a variety of different sizes and shapes beyond the fixed sizes of the chutes. In many embodiments a user may specify the type of currency within the software application executing on the user's device and the coin detection apparatus may determine the coin values of the coins passing through the apparatus based on this user selection.

In certain embodiments, the coin detection apparatus and/or software application may automatically determine a type of currency based on identifiable characteristics of the currency (e.g., size, weight, materials). For example, the apparatus may store identifying information for many different currencies, including the size (e.g., diameter, thickness), shape (e.g., circle, oval), material (e.g., metal type, alloy, nickel), weight, image information (e.g., images on the sides of the coins), among various other identifiable characteristics of each coin denomination issued by a particular currency issuer. Then, during coin detection, the coin detection application may identify coin types based on the information stored about the characteristics of coins for a currency type. For example, the apparatus may know that coins that have a diameter of 24.3 mm correspond to U.S. quarter and anytime the LED sensor array detects a coin with this diameter, the apparatus may associate the coin with a U.S. quarter, or, as described below, a set audio frequency that is then communicated with a software application.

As described above, the coin counting data may be communicated to a software application executing on a user device (e.g., smartphone). In many embodiments, the coin counting data may be communicated via a specific audio frequency that has a corresponding value associated with it based upon the denomination of the currency that it is. The audio range may be programmed to make sure the embedded software application can determine the varying values based on the coin type, size, and specified currency.

Various mechanisms may be utilized to communicate between a user device and a coin detection apparatus. In many embodiments the coin detection apparatus may plug directly into an auxiliary port (AUX) or microphone (mic) input of a user device (e.g., smartphone) for the purpose of relaying coin counting data to the device. This data may be read and interpreted by a software application on the device that works conjunctively with the hardware coin detection apparatus.

In certain embodiments, the coin detection apparatus may also be plugged directly into a data insert or charging cable opening, or any other input capable of accepting data inputs. Several embodiments may also use wireless communication standards, including Bluetooth™ (which is a wireless technology standard for exchanging data over short distances), Wi-fi, or any of a variety of wireless and/or wired technologies for communicating data between the coin detection apparatus and the external software application. This may allow the coin detection apparatus to function as a standalone apparatus and still maintain a data-sync with a software application executing on a user's device. Systems and methods for coin detection in accordance with embodiments of the invention are described below.

Coin Detection Apparatus Overview

By using light information to detect coin denominations, many embodiments of the coin detection apparatus are able to provide a compact design that includes a single coin path that includes an LED sensor array and may be used to detect coin types. The compact design also allows the counting apparatus to be connected to a user's external device running a coin counting software application for managing the user's coin counting activities. An example of a coin detection apparatus that communicates with a mobile device in accordance with an embodiment of the invention is illustrated in FIG. 1. In this example, the coin detection apparatus 105 is connected to a mobile device 110 using an input port on the mobile device. In some embodiments, the input port may be an auxiliary (AUX) input port and the coin detection apparatus may send audio frequency signals to the mobile device based on the type of coins being detected. The software application on the mobile device may then convert the audio frequency signals to corresponding coin values in order to track the coin counting activities.

As illustrated the coin detection apparatus 105 may be made of an outer plastic housing that may cover, among other items, the internal hardware, microcontroller, microprocessor, LED sensor array and photodiodes, and/or other hardware, software and/or other design elements needed to provide the various coin counting functionalities. The coin detection apparatus also includes an interchangeable plastic tray 115 that may allow a user to change the size of the tray based on their preferences and/or the type and size coins that will be passed through the counter.

Although FIG. 1 illustrates an example of a coin detection apparatus for counting coins and communicating with a mobile device using an input on the device, any of a variety of designs may be utilized for the coin counter as appropriate to the requirements of specific applications in accordance with embodiments of the invention. Yet another example of a coin detection apparatus communicating with a software application executing on a user's mobile device in accordance with an embodiment of the invention is illustrated in FIG. 2.

Figure 2:
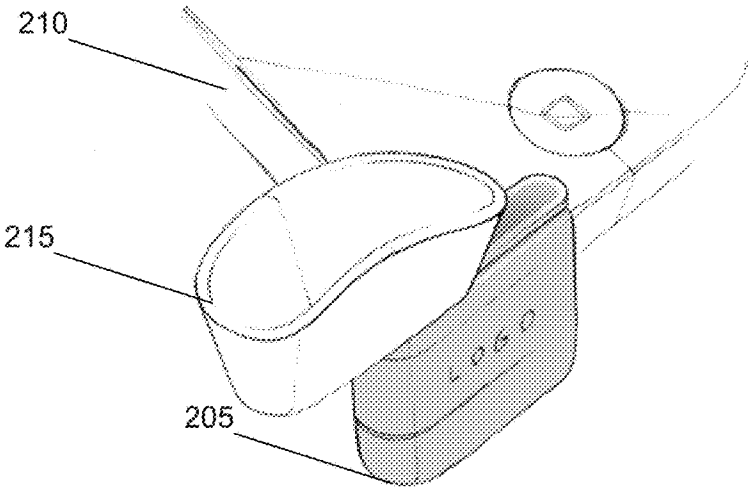
FIG. 2 illustrates another example of a coin detection apparatus that communicates with a mobile device in accordance with an embodiment of the invention.

FIG. 2 illustrates an example of a coin detection apparatus 205 connected with a user's smartphone 210 using an input on the phone. As illustrated in this example, the coin detection apparatus 205 includes an interchangeable tray 215 that can be changed to accommodate different sizes and/or volumes of coins that may need to be counted. Although FIG. 2 illustrates the coin detection apparatus being connected directly to a user device, many embodiments may utilize other types of connections for use in communicating data between the coin detection apparatus and the software application executing on the user device, including, for example, using Bluetooth, Wifi, among many other types of connections as appropriate to the requirements of specific applications in accordance with embodiments of the invention. Further design examples of a coin detection apparatus are illustrated below.

Coin Counting Apparatus Design

As described above, by utilizing a design that is able to distinguish coin types using light information as coins traveling through a single coin path, many embodiments are able to provide a more compact and streamlined coin counter design from many of the existing prior art coin counters, in particular, by eliminating the need for multiple chutes within the counting apparatus for sorting coins. Examples of a compactly designed coin detection apparatus that utilizes light information to detect coin denominations as coins move through a coin path in accordance with embodiments of the invention are illustrated in FIGS. 3-6.

Figure 3:
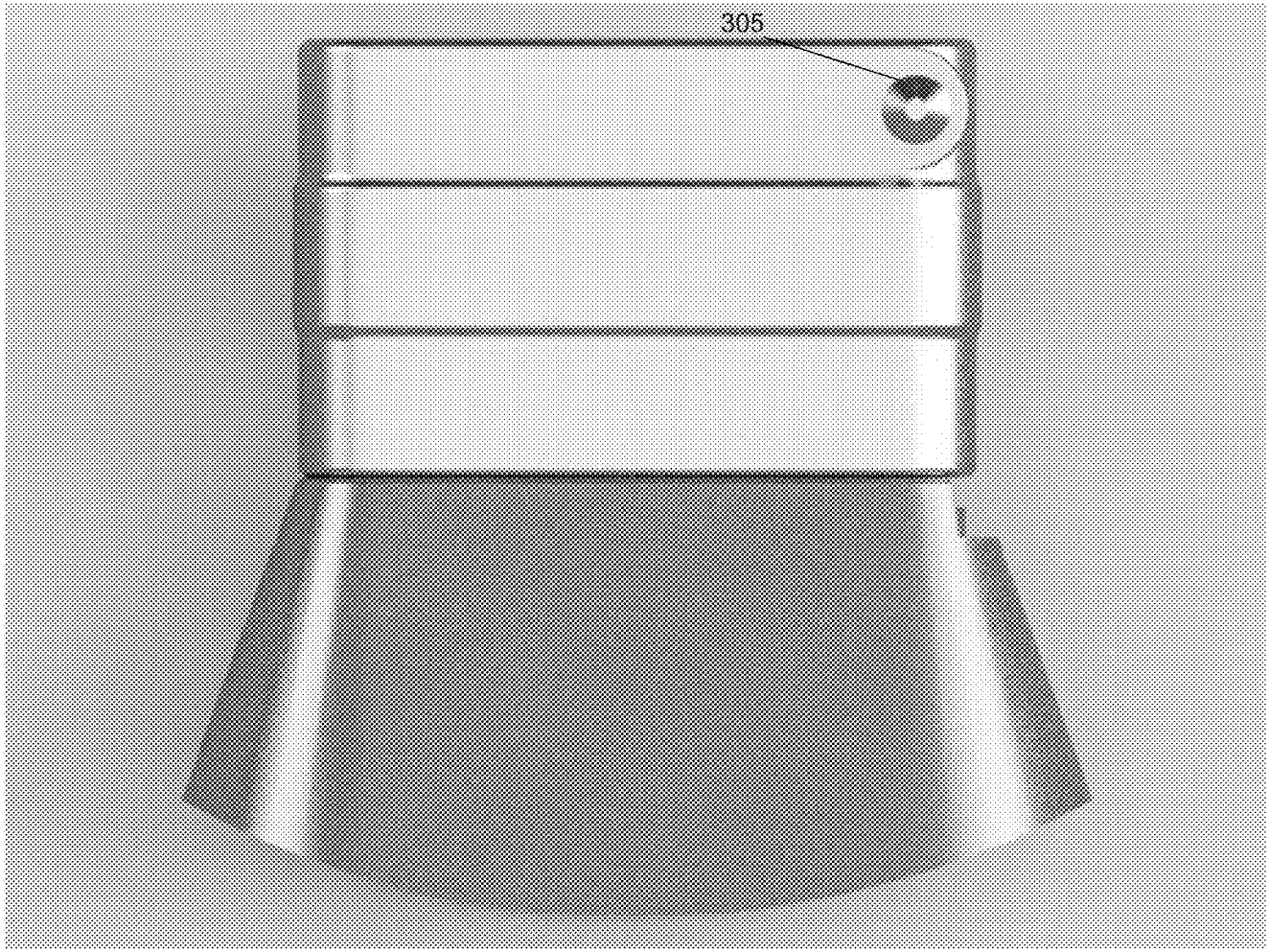
FIG. 3 illustrates a front view of a coin detection apparatus in accordance with an embodiment of the invention.
Figure 4:
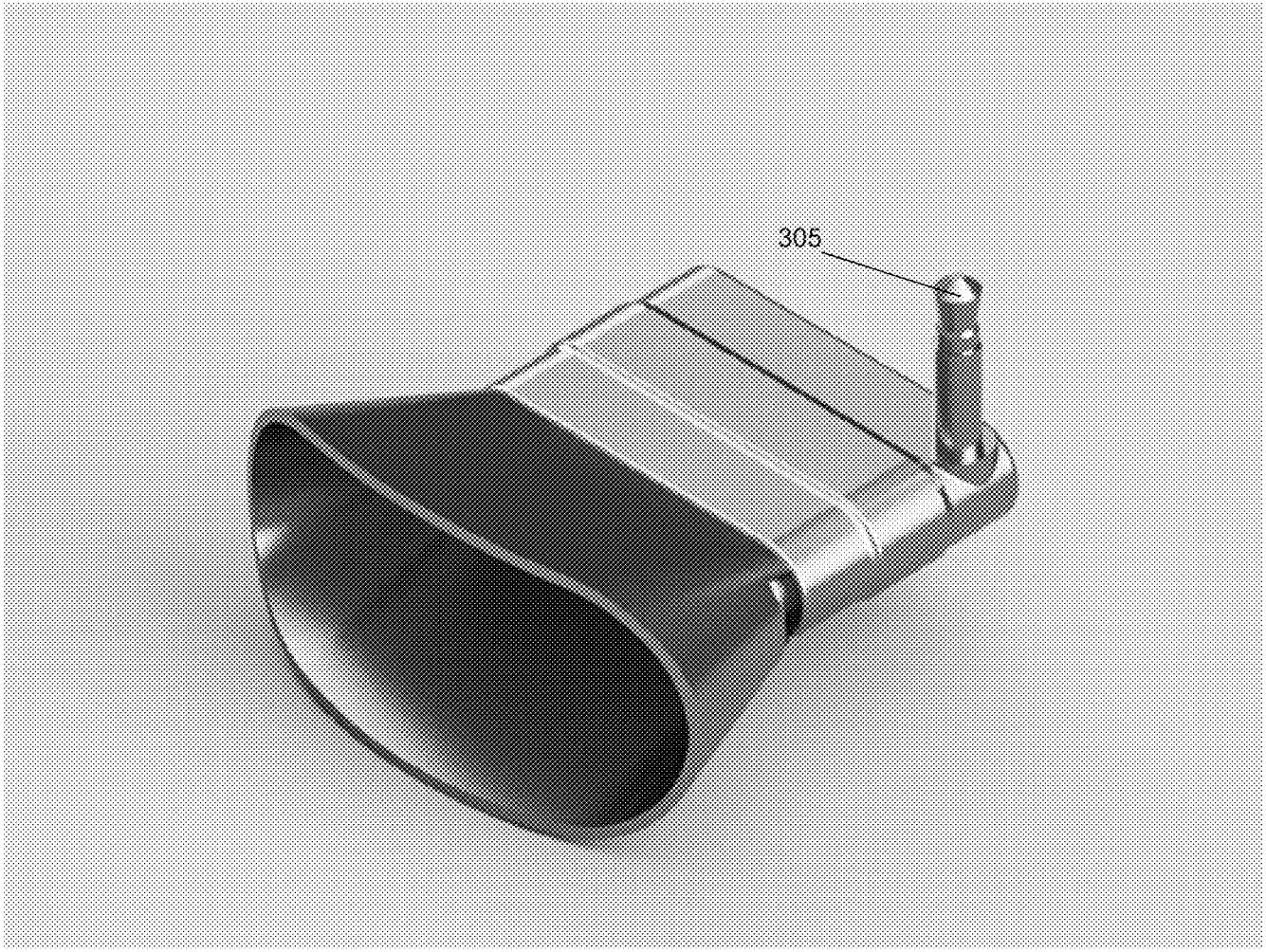
FIG. 4 illustrates combination of a side and frontal view of a coin detection apparatus in accordance with an embodiment of the invention.
Figure 5:
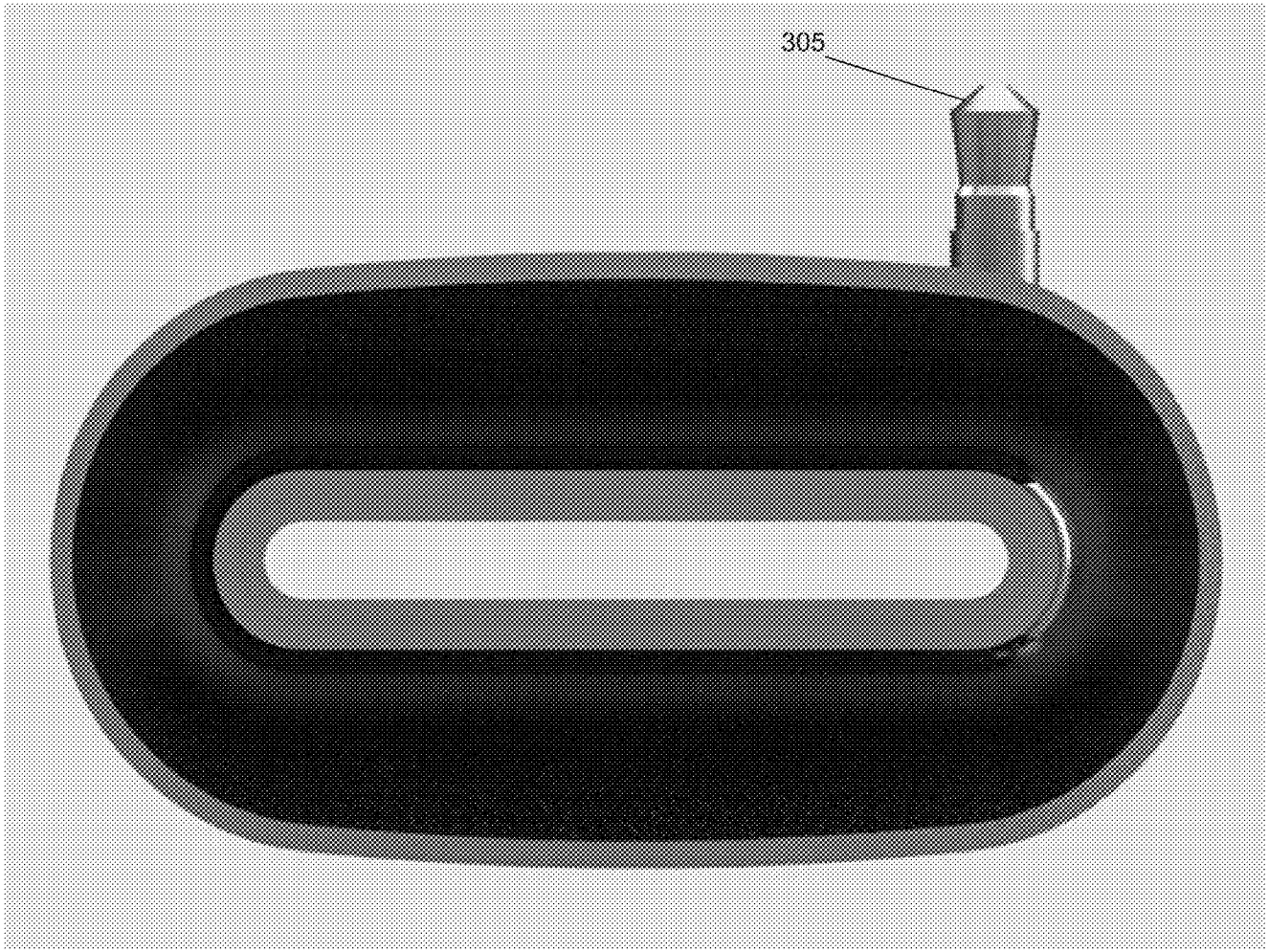
FIG. 5 illustrates a top view of a coin detection apparatus in accordance with an embodiment of the invention.
Figure 6:
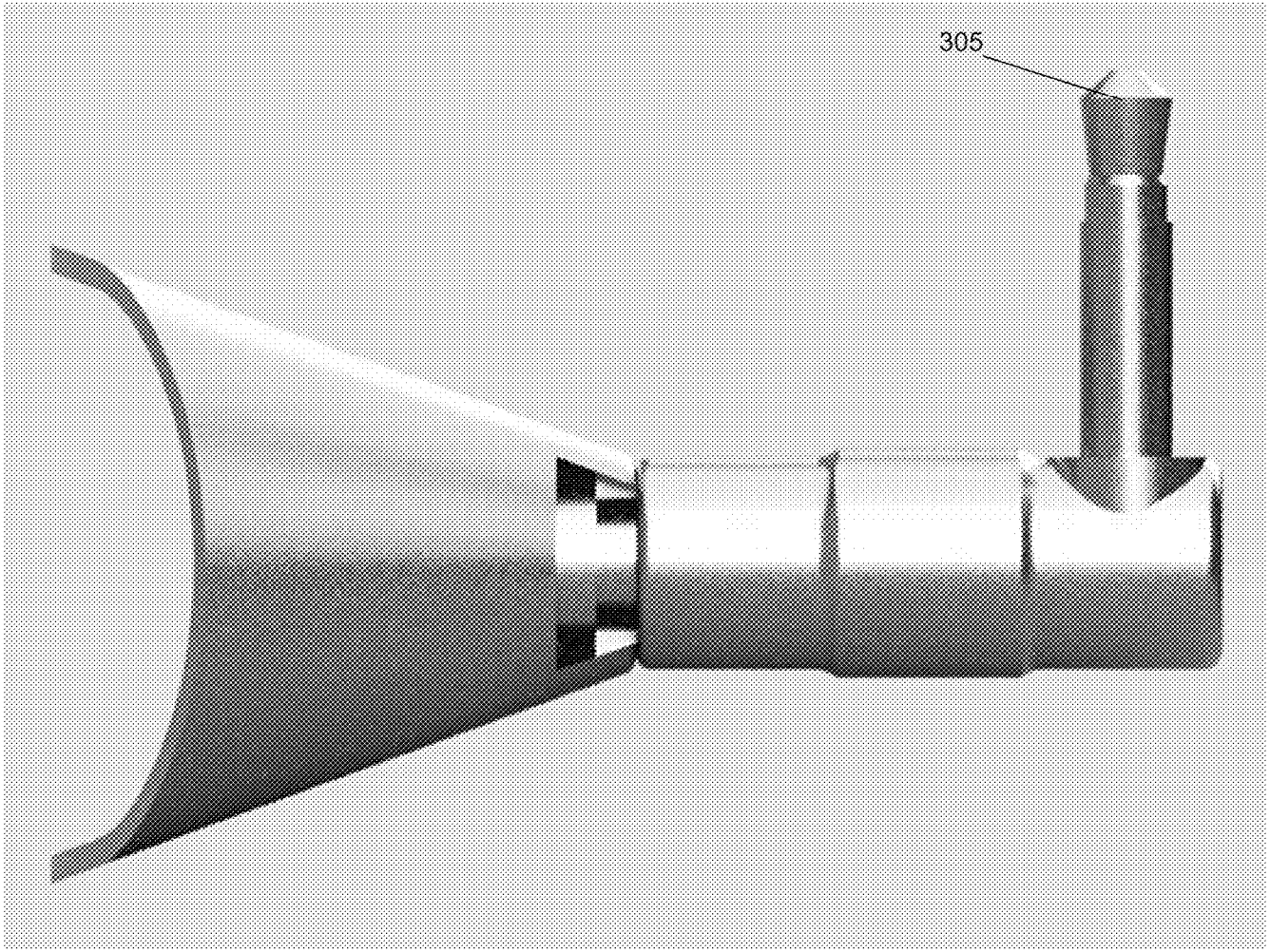
FIG. 6 illustrates a side view of a coin detection apparatus in accordance with an embodiment of the invention.

In particular, FIGS. 3-6 illustrate various different viewpoints of an example of a coin detection apparatus that may be used to count coins and provide data to a user device in accordance with an embodiment of an invention. In particular, FIG. 3 illustrates a front view of the coin detection apparatus, FIG. 4 illustrates combination of a side and frontal view of the coin detection apparatus, FIG. 5 illustrates a top view of the coin detection apparatus, and FIG. 6 illustrates a side view of a coin detection apparatus in accordance with an embodiment of the invention. As illustrated in these figures, the coin detection apparatus may include an antenna 305 that can be used to communicate with an external software application (e.g., an application executing on a user device). The coin detection apparatus may be as small as several inches in each direction, and thus could easily fit within small bag or backpack of a user. Although FIGS. 3-6 illustrate an example of a design of a coin detection apparatus, any of a variety of different designs may be specified as appropriate to the requirements of specific applications in accordance with embodiments of the invention.

Figure 7:
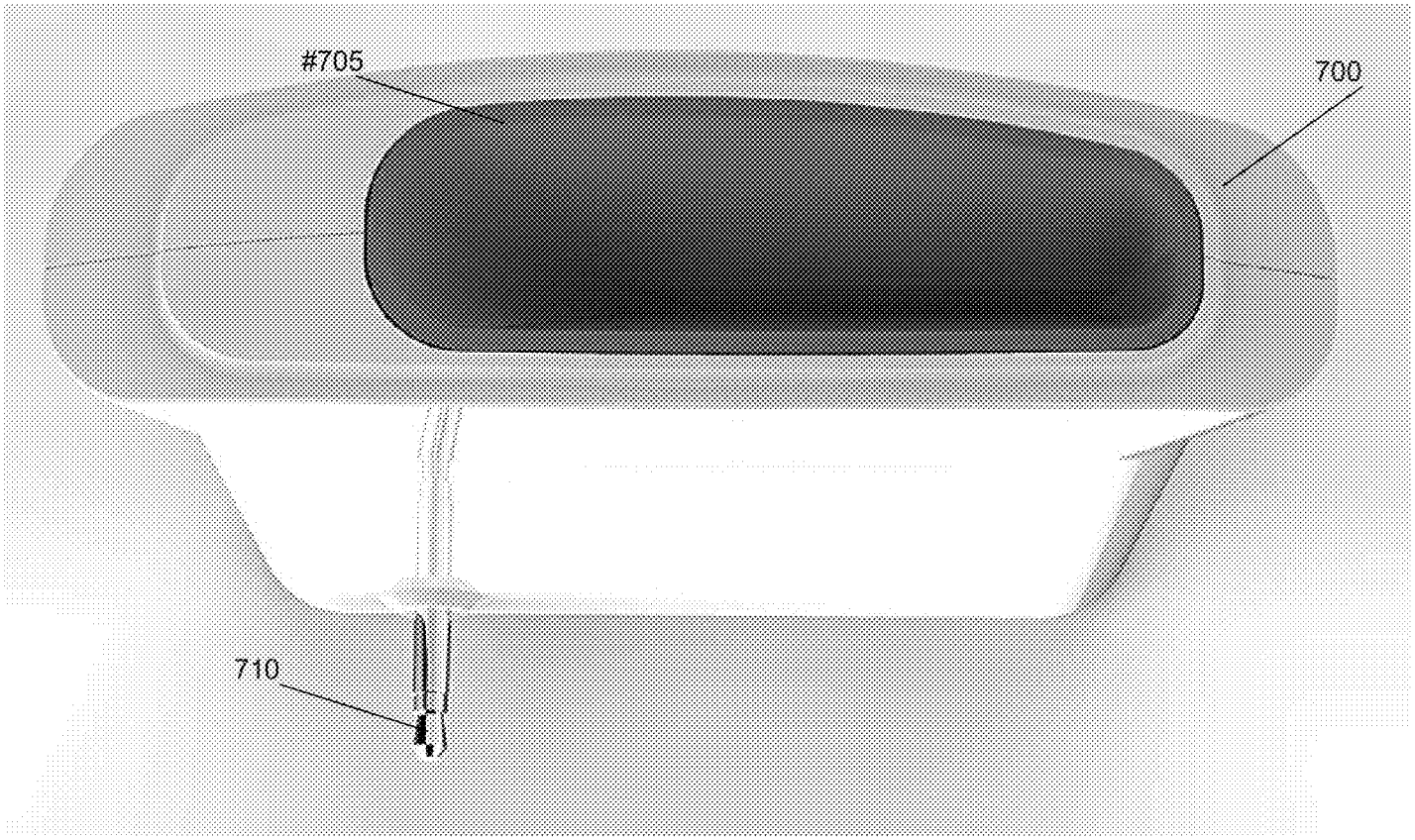
FIG. 7 illustrates a top view of a coin detection apparatus in accordance with an embodiment of the invention.
Figure 8:
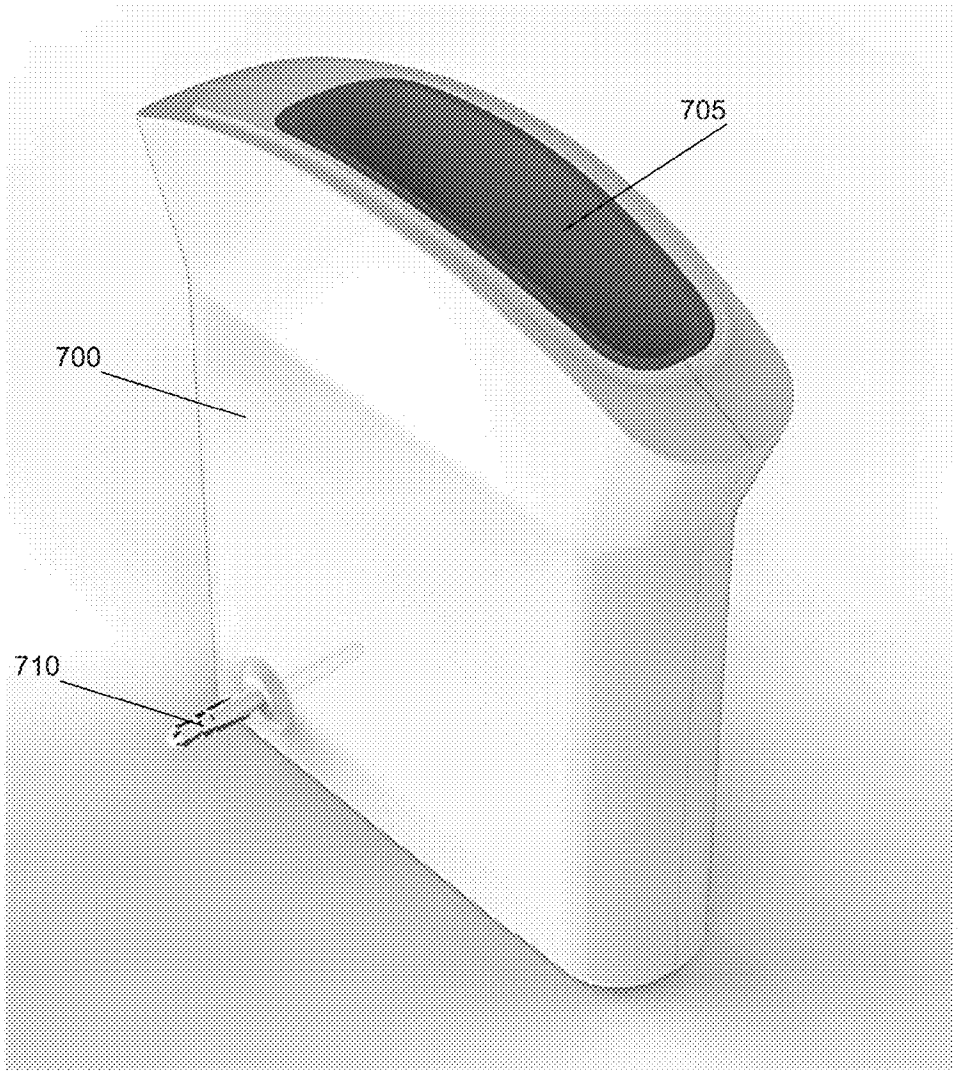
FIG. 8 illustrates a coin detection apparatus in accordance with an embodiment of the invention.
Figure 9:
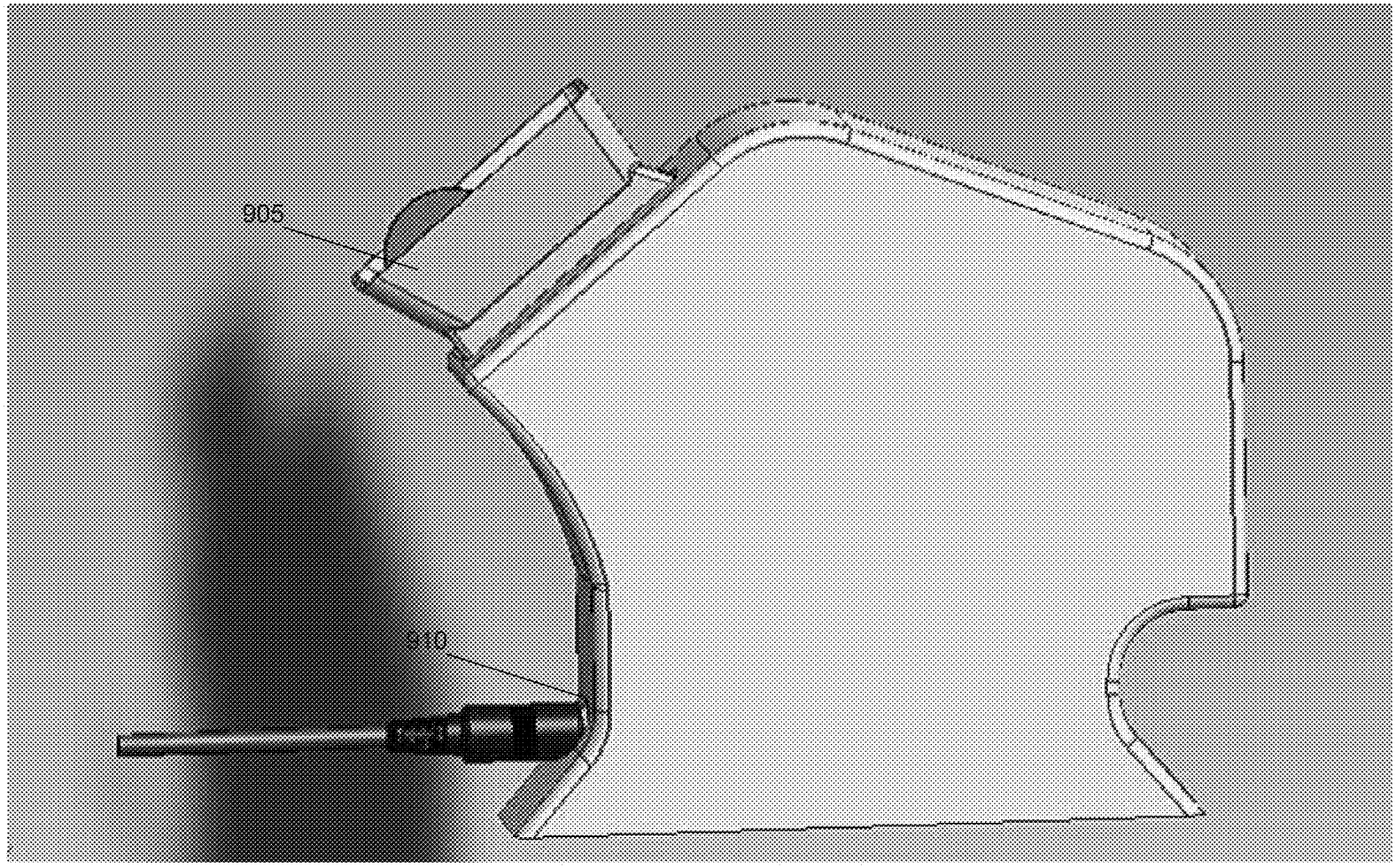
FIG. 9 illustrates a coin detection apparatus connected to an external device in accordance with an embodiment of the invention.

Other designs may be utilized for the coin detection apparatus. Examples of several other designs for a coin detection apparatus in accordance with embodiments of the invention are illustrated in FIGS. 7-9. In particular, FIG. 7 illustrates a top view and FIG. 8 illustrates a frontal/top/side view of a coin detection apparatus 700 in accordance with an embodiment of the invention. As illustrated, the apparatus includes an opening 705 for inserting coins to be counted and an antenna 710 for communicating with an external device. FIG. 9 illustrates yet another design for a coin detection apparatus 900 in accordance with an embodiment of the invention, including the insert 905 for inserting coins, and in input 910 to connect with an external device. Although FIGS. 7-9 illustrate various designs of a coin detection apparatus, any of a variety of different designs may be utilized as appropriate to the requirements of specific applications in accordance with embodiments of the invention. Furthermore, the coin counting design may be used in any of a variety of different apparatuses that may need to detect the identity of coins, including parking meters, vending machines, slot machines, laundry machines, among any other apparatus that uses coins. System architectures for coin counters in accordance with embodiments of the invention are described below.

Coin Counter System Architecture

Figure 10:
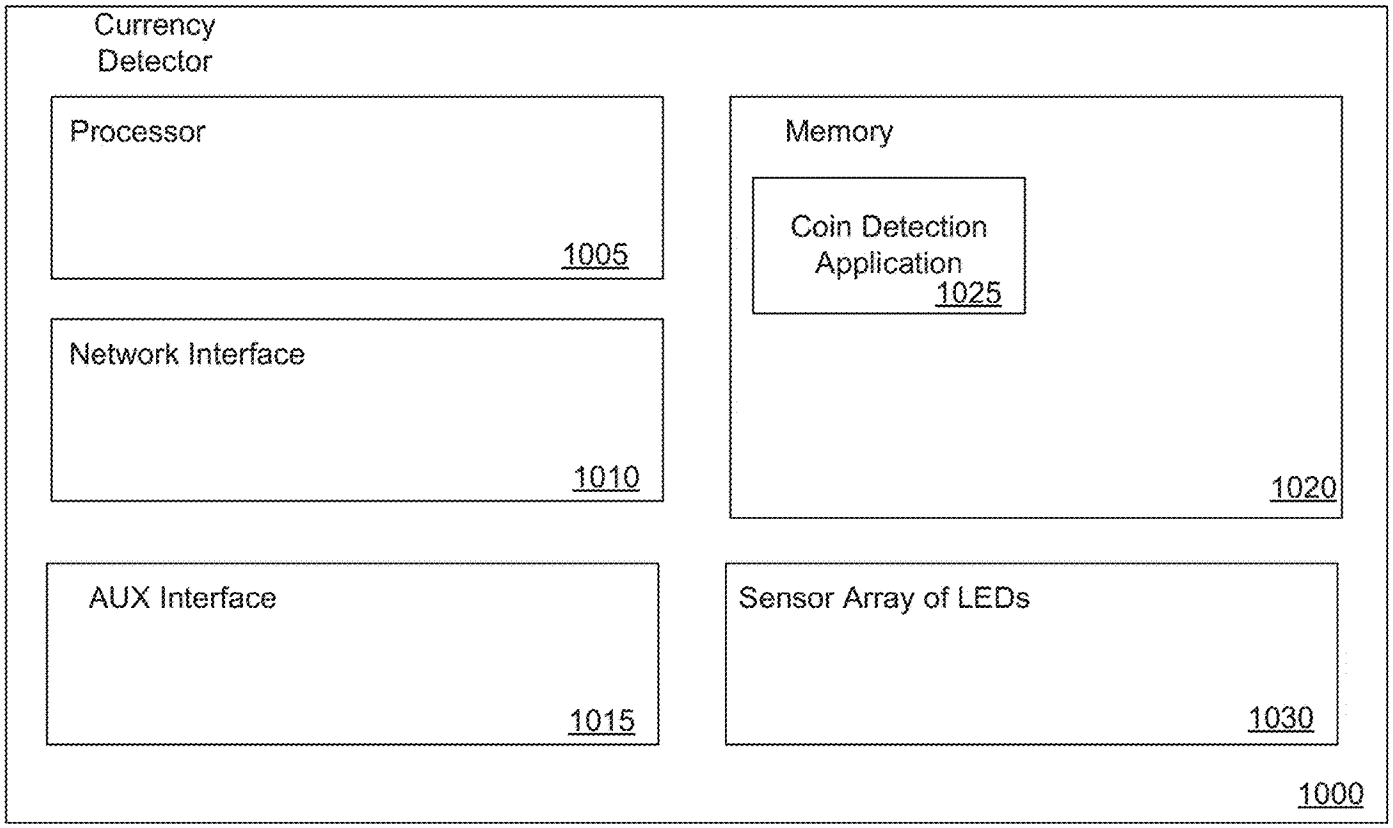
FIG. 10 illustrates a basic architecture of a coin detection apparatus in accordance with an embodiment of the invention.

As described above, the coin detection apparatus may identify coin types and send the coin counting data to a software application executing on an external user device. An example of the basic architecture of a coin detection apparatus in accordance with an embodiment of the invention is illustrated in FIG. 10. The coin detection apparatus 1000 includes a processor 1005 in communication with a memory 1025, a network interface 1110, an AUX interface 1015, and one or more LED sensor arrays 1030. In many embodiments, the coin counter system may be implemented using a combination of software, hardware, and/or firmware. In certain embodiments, the coin counter may be implemented using a microcontroller. In particular, certain embodiments may utilize the MSP430 mixed-signal microcontroller from Texas Instruments Incorporated of Dallas, Tex. Use of the MPS430 may enable low power consumption embedded applications. The microcontroller may obtain light information from a sensor array of LEDs 1030 (and corresponding photodiodes) and analyze this information in order to detect a sizes and shape of coins being input into the apparatus. In many embodiments, the microcontroller may determine which subset of LED light beams were blocked by a coin passing across the light beams in order to determine the size of the coin, which can then be used to identify the type of coin. In other embodiments, the microcontroller may obtain information about the size and shape of coins using any of a variety of sensors capable of sensing this information, including optical cameras, infrared devices, and various other types of sensors.

In the illustrated embodiment, the memory includes a coin detection application 1025 that configures the processor to detect coins and send data to an external device executing a coin counting application. In order to relay data to an external device, the coin counter 1000 may use the network interface 1010 that may provide a Bluetooth, Wi-Fi, and/or other type of wireless network connection. Certain embodiments may utilize the AUX interface 1015 to submit data packets to various different input ports of an external device. In several embodiments, the network interface 1010 may be in communication with the processor 1020, and/or the memory 1020. Although a specific coin counter device architecture is illustrated in FIG. 1000, any of a variety of architectures can be utilized to implement coin counter devices in accordance with embodiments of the invention.

User Device System Architecture

Figure 11:
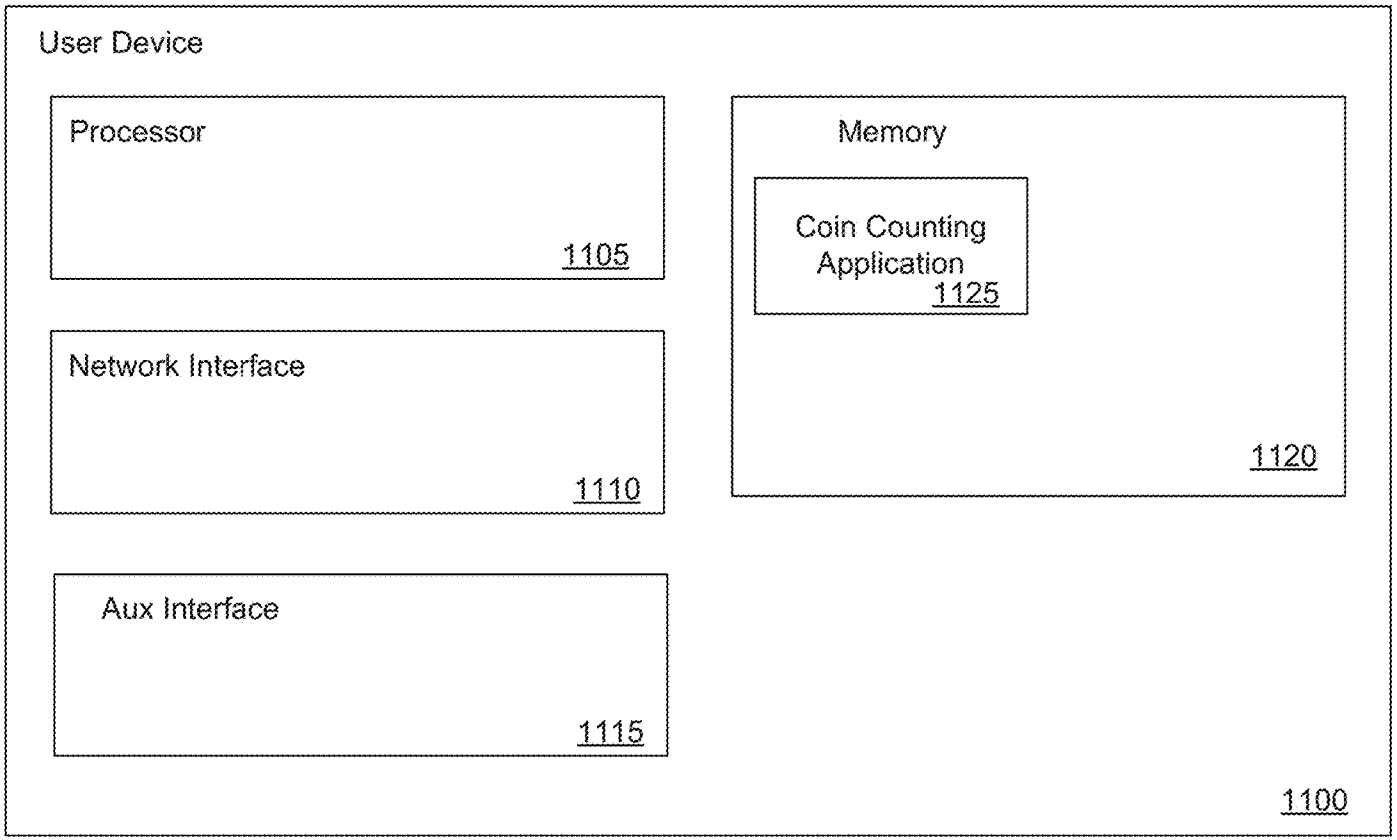
FIG. 11 illustrates a basic architecture of a user device in accordance with an embodiment of the invention.

In many embodiments, a coin detection apparatus may communicate coin counting data to an external software application that is executing on a user's device such as a smartphone. An example of the basic architecture of a user device in accordance with an embodiment of the invention is illustrated in FIG. 11. The user device 1100 includes a processor 1105 in communication with memory 1120, a network interface 1110 and an AUX interface 1115. In the illustrated embodiment, the memory includes a coin counting application 1125 that configures the processor to count coins using coin data obtained from an external coin detection apparatus. In many embodiments the coin counting application may obtain coin counting data from the external coin detection apparatus using a variety of different communication channels, including various wired or wireless network connections (e.g., Bluetooth, Wifi, LAN line, Ethernet, among many others) using the network interface (1110) Bluetooth, AUX and/or microphone inputs from the AUX interface 1115, among other channels for receiving data from the external coin detection apparatus. In certain embodiments, the coin counting application may obtain audio data, such as different audio frequencies that each correspond to a particular type of coin, from the coin detection apparatus. The coin counting application 1125 may recognize the frequency associated with a particular coin type and convert the frequency data to data regarding the monetary value of the coin for counting purposes. The coin counting application may track the monetary amount of coins being counted and provide this information to the user of the device.

In several embodiments, the network interface 1110 may be in communication with the processor 1120, and/or the memory 1120. Although a specific user device architecture is illustrated in FIG. 11, any of a variety of architectures can be utilized to implement user devices in accordance with embodiments of the invention.

LED Array Design

Figure 12:
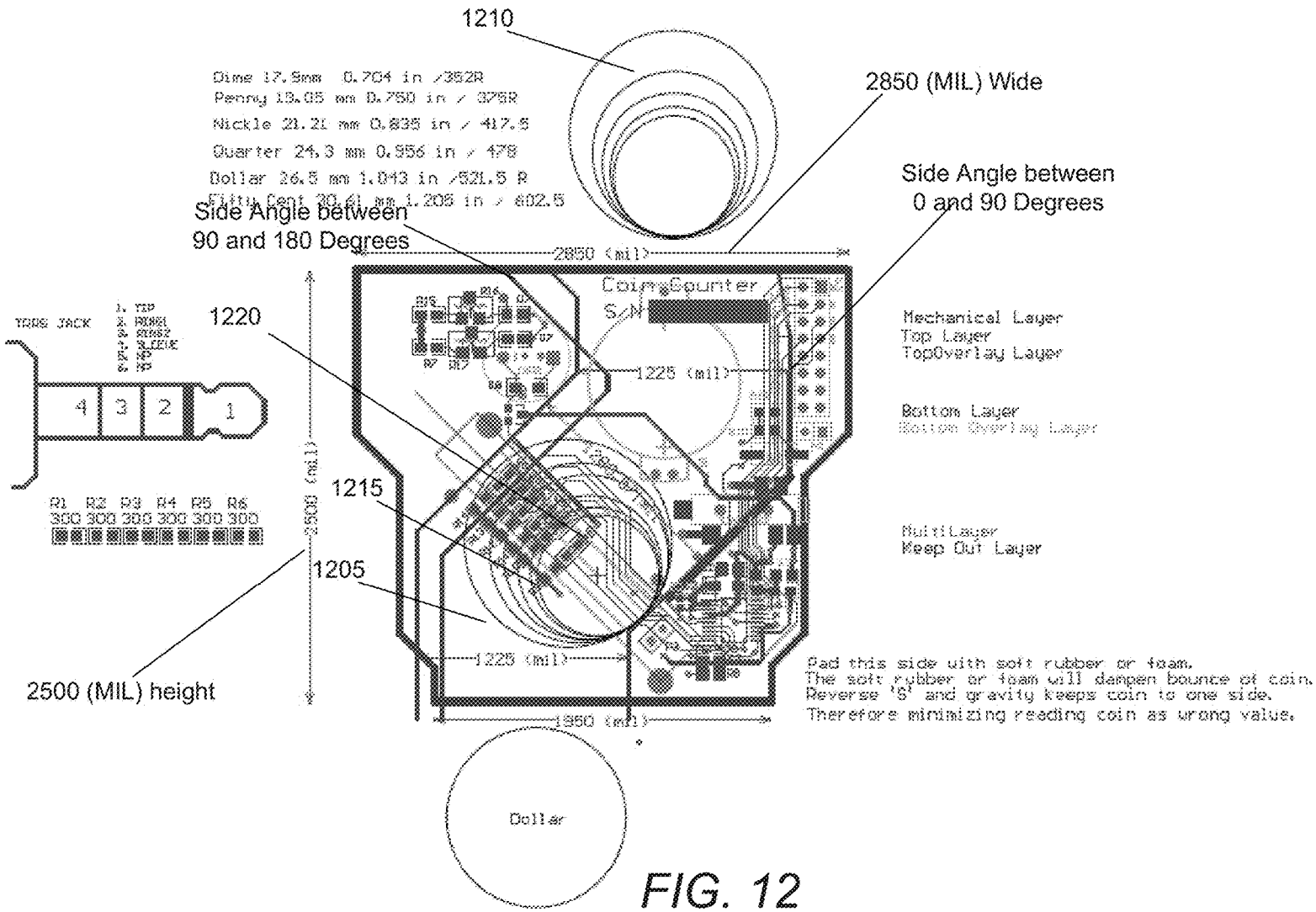
FIG. 12 provides a schematic coin counter design that illustrates a coin path within the coin detection apparatus that includes an LED sensor array in accordance with an embodiment of the invention.

In order to provide a streamlined design that is able to accommodate any coin size that may be issued by any currency issuer, many embodiments of invention utilize light information obtained from a sensor array of LEDs in order to identify coin denominations. An example of a schematic coin counter design that illustrates a coin path within a coin detection apparatus that includes an LED sensor array in accordance with an embodiment of the invention is illustrated in FIG. 12.

The schematic illustrates the coin path 1205 through which different types of coins may travel during coin counting. As illustrated by the various coin examples 1210, each type of coin may have certain physical attributes, including size (e.g., diameter), weight, type of alloy or metal of the coin, among various other identifying features. Each of these identifying features may be detected using one or more different types of sensors. In many embodiments, a size and shape of a coin, which may be used to identify the type of coin, may be detected using a sensor array of LED light beams 1215 that each transmit a light beam across the coin path 1205 to a corresponding array of photodiodes 1220 that sense the light being transmitted. When a coin travels through the coin path, it may cause an interference in the light being transmitted across the path, and based on the size of the coin, different LED light beams being transmitted by the LED sensor array may be blocked by the coin. As illustrated in the figure, the size of various U.S. coins 1210 are illustrated within the coin path, with each size of coin interfering with a subset of the LED light beams in the sensor array of LEDs 1215. For example, the LED sensor array may include 6 LEDS, and a U.S. penny may block light from only 1 LED light beam in the sensor array, while a Silver Dollar may block light from all of the LED light beams.

Furthermore, in many embodiments, in order to reduce the effects of noise that may be generated due to coins bouncing through the coin path as they travel through the coin counter, many embodiments slope the coin path at an angle such that the coins roll down the slope, rather than, for example, free-fall through the path. Likewise, many embodiments may use a shock absorbent material, such as a soft rubber or foam that dampens the bounce of coins entering the coin path.

As illustrated, the coin path is initially slopped at an angle, "S", and then the direction of the slope is reversed at a direction that is the reverse of "S" at which the LED sensor array is positioned. By using this structure along with the shock absorbent material, many embodiments may significantly reduce the effects of coins bouncing through the coin path and through the LED light beams and thus provide for increased accuracy with which the size and shape of coins may be ascertained based on the light interference patterns. Although FIG. 12 illustrates using a certain sloped structure for the coin path, any of a variety of sloped designed may be utilized that are able to reduce the effects of noise in as appropriate to the requirements of specific applications in accordance with embodiments of the invention. Furthermore, although FIG. 12 illustrates using a sensor array of LED light beams, any of a variety of different types of sensors that are able to detect a size and shape of objects may be utilized as appropriate to the requirements of specific applications in accordance with embodiments of the invention.

Figure 13:
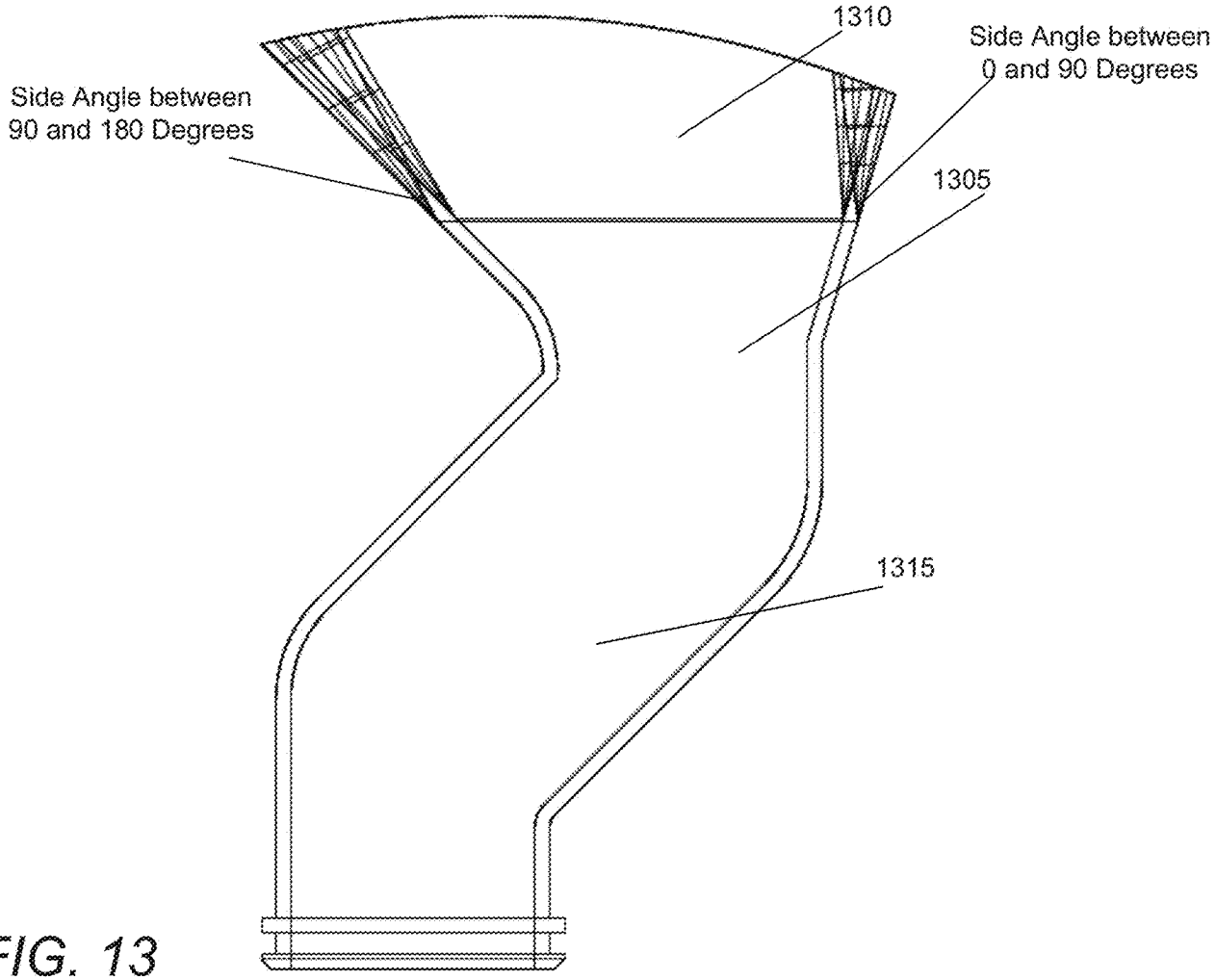
FIG. 13 illustrates a schematic frontal 3-dimensional view of a coin path design in accordance with an embodiment of the invention.
Figure 14:
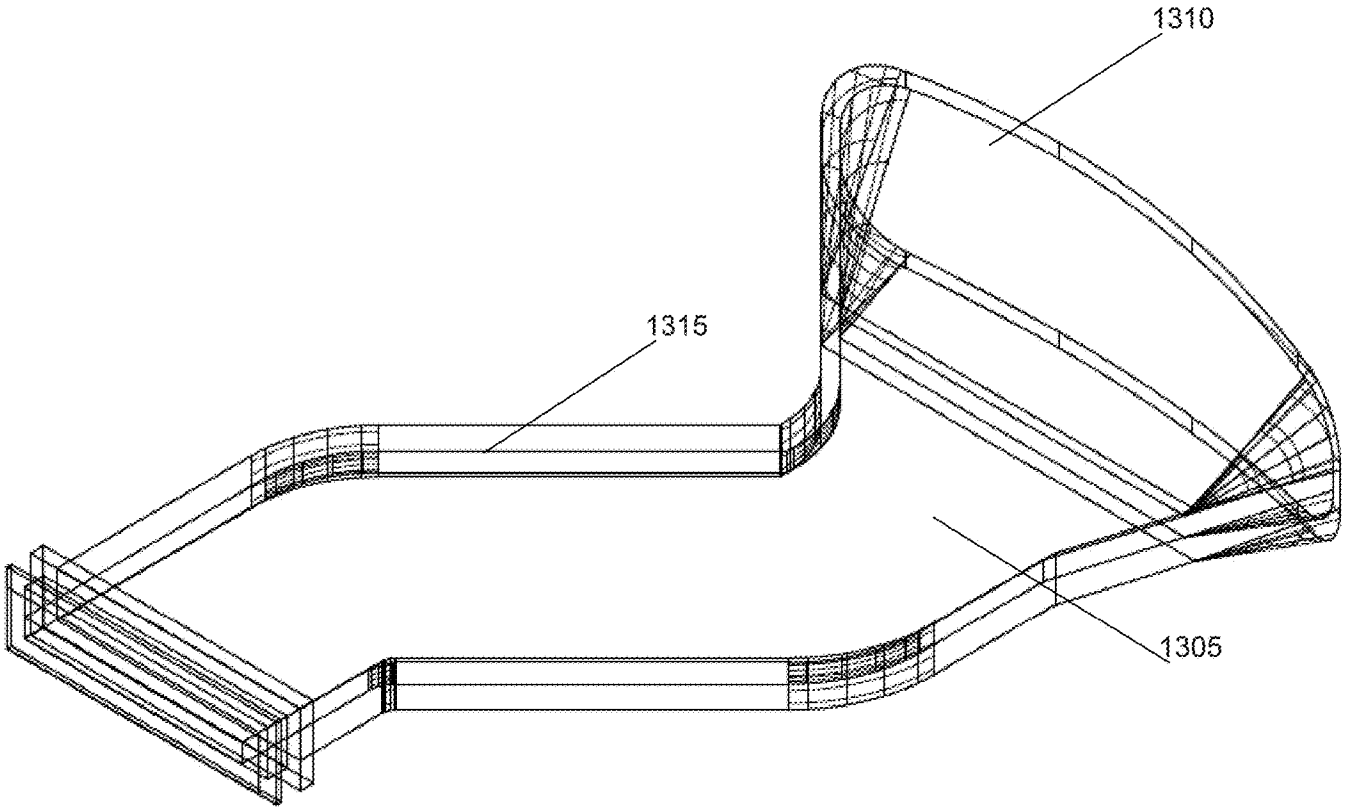
FIG. 14 illustrates a schematic 3-dimensional view of a coin path design in accordance with an embodiment of the invention.

As described above, utilizing a sloped design for portions of the coin path may eliminate coin bounce as a coin travels through a coin apparatus. An example of a sloped coin path in accordance with an embodiment of the invention is illustrated in FIGS. 13-14. In particular, FIG. 13 illustrates a 3-dimensional frontal view while FIG. 14 illustrates a 3-D front and side view of a coin path 1305 that may be used within an apparatus that needs to identify coins. As illustrated, an opening 1310 of the coin path may be used to insert coins within the apparatus. The coin then travels down and into a sloped portion 1315 of the path 1305. The sloped portion 1315 may be implemented using a material, such as a rubber or foam, that may be able to absorb the shock of a coin entering into the coin path 1305 and thus minimize, if not completely eliminate, the possibility of coins bouncing through the coin path. Furthermore, an LED sensor array may be positioned within this sloped portion 1315 of the coin path, at which point it may be used to detect the type of coins moving through the coin path 1305. As described above, many embodiments utilize an LED sensor array that transmits light beams across the coin path 1305 in order to detect the size (e.g., diameter) of coins, and by placing the sensor array within the sloped portion 1315 at which point coin bounce may have been eliminated, the light beams being analyzed to identify coin types will be free from any of the noise issues that would otherwise be present due to coin bounce and thus the accuracy of the coin detection is not compromised. Although FIG. 13-14 illustrate using a certain sloped structure for a coin path at a particular angle, any of a variety of sloped paths at a variety of different angles may be utilized as appropriate to the requirements of specific applications in accordance with embodiments of the invention.

Coin Detection Process

Figure 15:
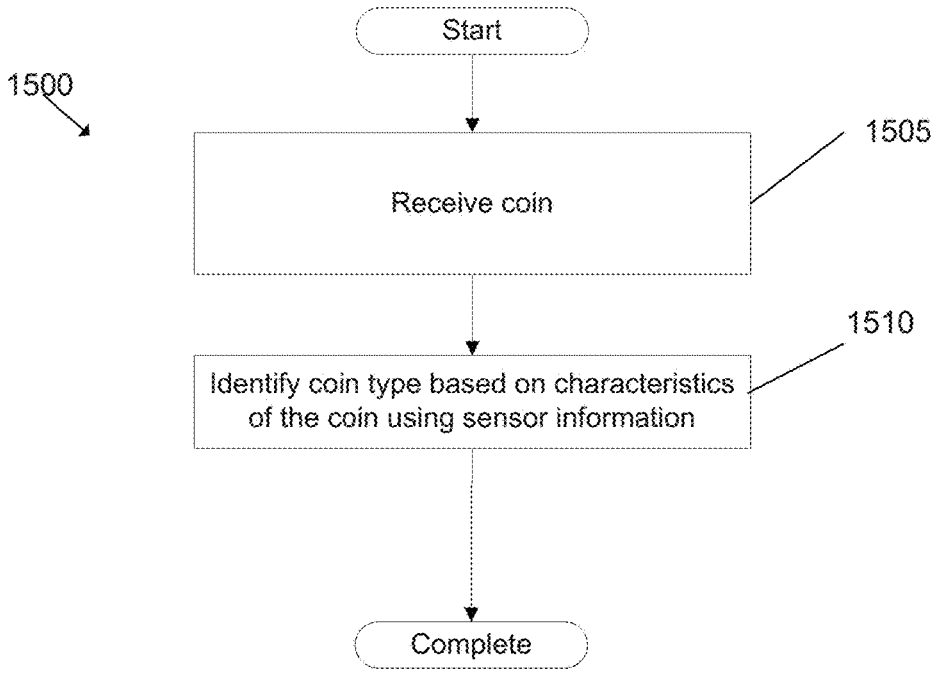
FIG. 15 illustrates a flowchart for a method of identifying a coin type based on characteristics of a coin in accordance with an embodiment of the invention.

As described above, many embodiments of the invention are able to identify coin types based on one or more characteristics of a coin. In particular, many embodiments utilizes a coin's size in order to detect the denomination of the coin. A process for coin detection in accordance with an embodiment of the invention is illustrated in FIG. 15. The process 1500 receives (at 1805) a coin. The process identifies (at 1510) a coin type for the coin based on characteristics of the coin. In some embodiments, the process identifies the characteristics of the coin using information obtained from a sensor. The characteristics may include the size of the coin (e.g., diameter, thickness), weight, material type, image designs on the coin surfaces, surface texture, among various other characteristics that may be used to identify a coin type. In many embodiments, the sensor may be an LED sensor array that includes one or more LED light beams that each transmit light across a path through which the coin travels. In particular, based on which set of LED light beams are interfered with as a coin travels through the coin path, the process may determine the size of the coin. For example, in an LED sensor array that transmits 6 LED light beams across a coin path, a penny traveling through the path may interfere with only 1 of the LED light beams, while a Silver Dollar may interfere with all 6 of the LED light beams. Thus, based on the amount of light being blocked, the process may then determine a type of coin passing through. In certain embodiments, the process may use other types of sensors capable of detecting characteristics of coins, including other types of light beams, infrared sensors, and/or other sensors as appropriate to the requirements of specific applications. In some embodiments, the process may also communicate this information with an external device.

Although a process for identifying coins is described in FIG. 15, any of a variety of processes may be used to identify coins as appropriate to the requirements of specific applications in accordance with embodiments of the invention.

Hardware Design

Figure 16:
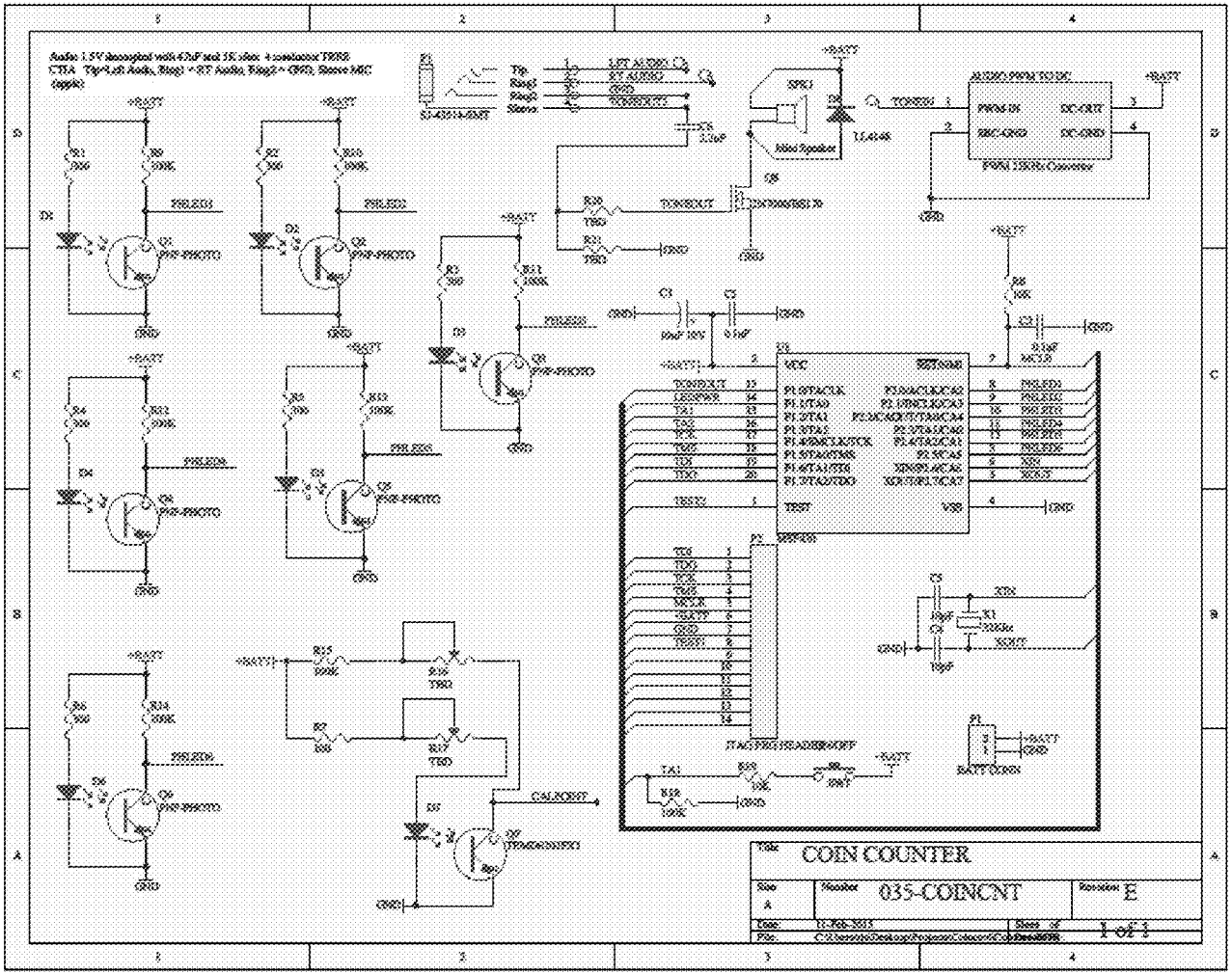
FIG. 16 illustrates a schematic diagram of details of the circuitry of a coin detection apparatus in accordance with an embodiment of the invention.

FIG. 16 is a detailed schematic diagram of an embodiment of the invention illustrating certain details of the circuitry of a coin detection apparatus in accordance with an embodiment of the invention. In some embodiments, the microprocessor is powered and queued by a connection with a user device (e.g., cell phone) transmitting an audio tone. In particular, the coin detection apparatus may use the audio tone to obtain power from the user device. The circuit may use the audio output from a user device and expects the device to output an audio tone. It may then take this audio tone through its own analog circuit by treating audio output from the device as a pulse width modulated (PWM) DC/DC converter. In certain embodiments, the apparatus may have its own power (e.g., triple A) in the event that the PWM from the cell phone is not enough power. This may provide a mechanism to conserve power by relying on the user device to 'turn-on' or queue up the micro-processor within the coin detection apparatus.

In many embodiments, the micro-controller may create a pulse-width modulated signal to produce an audio frequency, and it may also use impedance matching analog circuitry to match the mic input, which is output back to the user device. In certain embodiments, the output may consist of a physical speaker and a physical audio connection and goes to two spots, giving the choice of where to get it from. One spot is a simple SMT (surface mount) speaker that can or can-not be populated to keep the cost down if not used and also to an audio output 3.5 mm jack. The audio jack may have the following: input (R,L), output (mic) and ground. Note that the left and right audio may be coming from the user device (e.g., cell phone) and mic in may be mono output. In the event that there is not a mic input on the user device, the software application then has to identify coins based on audio SMT speaker output.

Based off of different tones, the user device executing the coin counting software application may know what coin passed through the coin detection apparatus based on the frequency of the coin and silent when no coin is passing. In some embodiments, the larger the coin, the higher the frequency tone. In many embodiments, the coin counting software executing on a user device may recognize the frequency and calculate a value based on the currency and frequency from the audio range. In many embodiments, the coin counting application is able to recognize different frequencies that correspond to different types of coins, and convert the frequencies into their respected currency values. In certain embodiments, if the frequencies are played from a speaker, they may resemble musical notes that generate unique melodies when coins are being dropped through the coin detection apparatus.

User Interface

Figure 17:
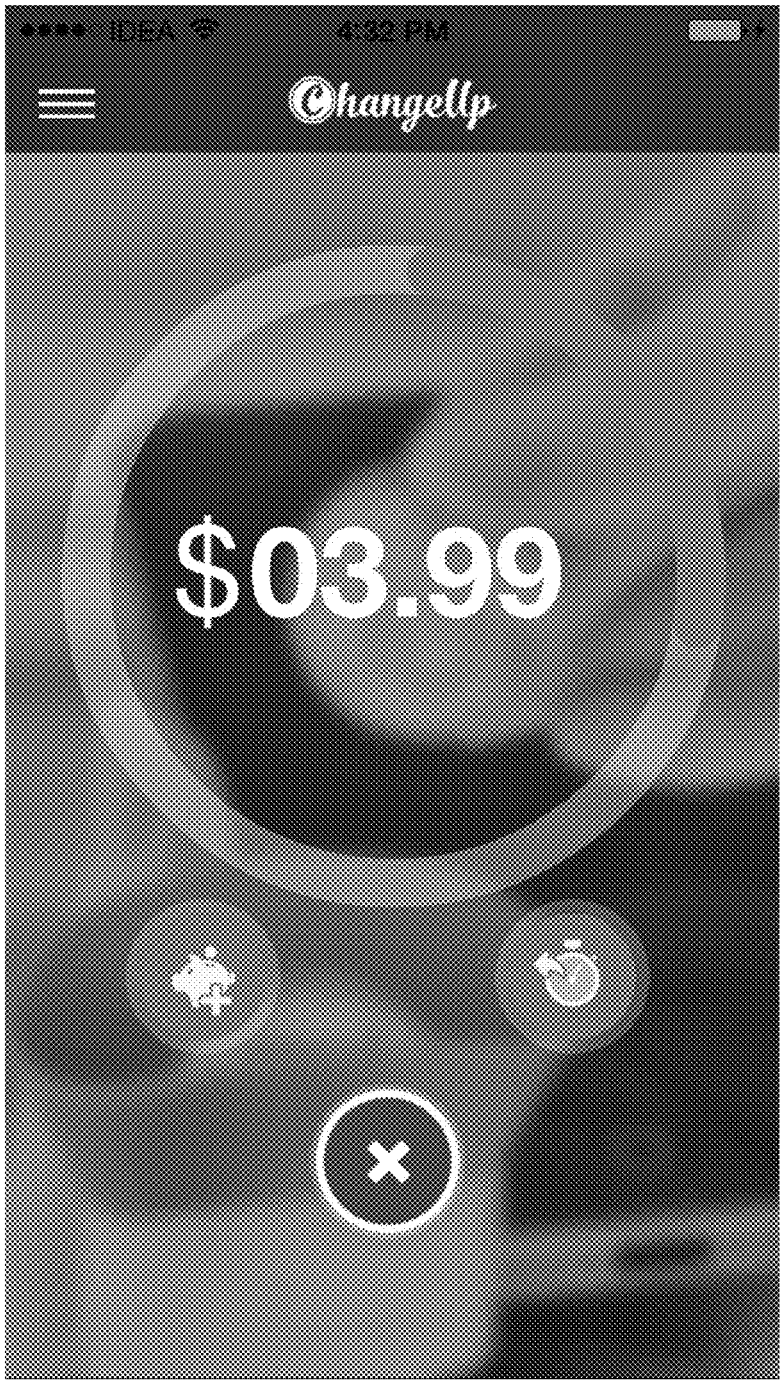
FIG. 17 illustrates a user interface of a coin counting application executing on a user's smartphone in accordance with an embodiments of the invention.
Figure 18:
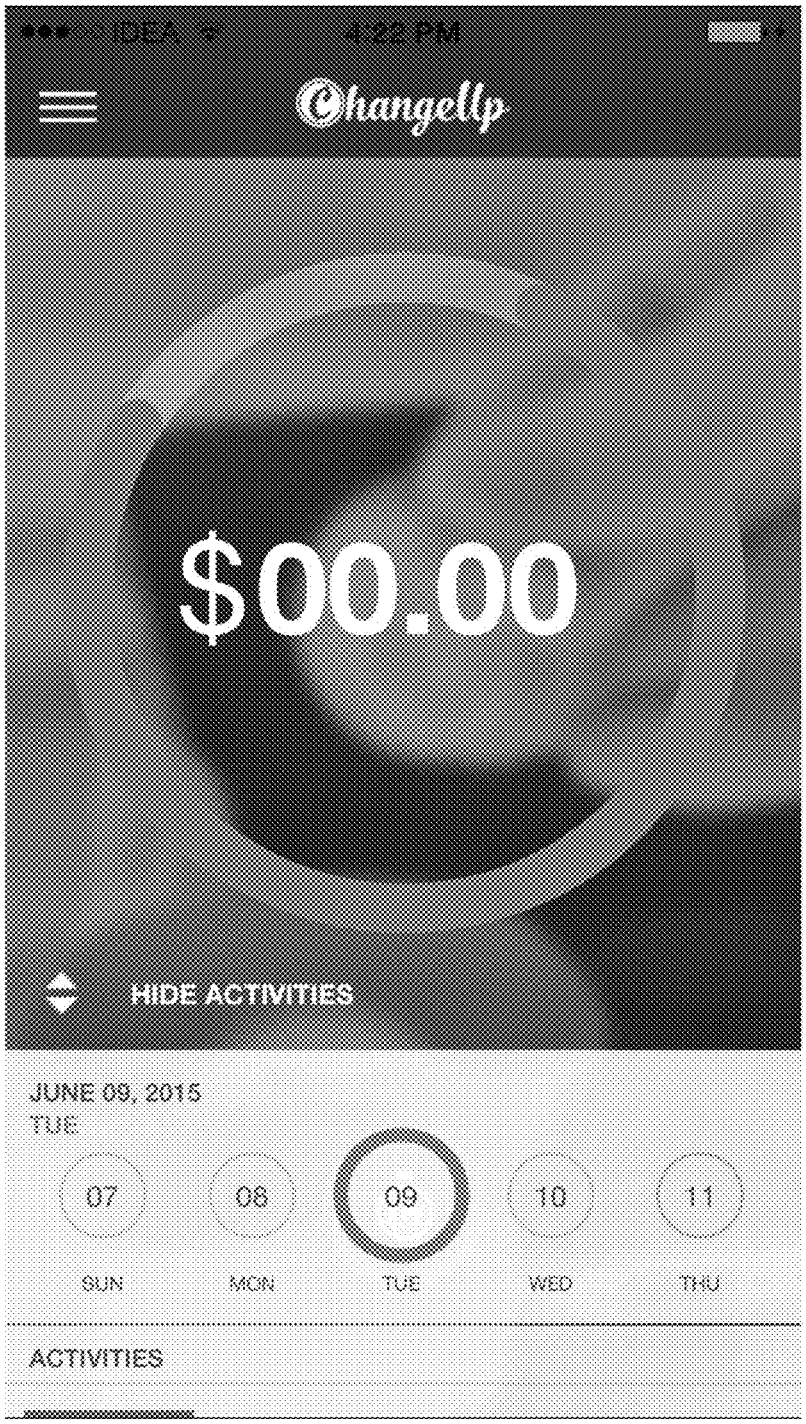
FIG. 18 illustrates a user interface of a coin counting application executing on a user device in accordance with an embodiment of the invention.

The coin counting application executing on a user device may provide the user with various information pertaining to their coin counting activities. Examples of the user interface of a coin counting application in accordance with embodiments of the invention are illustrated in FIGS. 17-18. In particular, FIG. 17 illustrates the user interface of the coin counting application executing on a user's smartphone. The display provides the current amount of coins being counted (e.g., $3.99), and several other icons that may provide various different functionalities. FIG. 18 illustrates another user interface screenshot of the coin counting application in accordance with an embodiment of the invention. In particular, FIG. 18 provides a user's activities for different days of the week. Although FIGS. 17-18 illustrate certain user interfaces of a coin counting application, any of a variety of user interface designs may be utilized as appropriate to the requirements of specific applications in accordance with embodiments of the invention.

Furthermore, although the present invention has been described in certain specific aspects, many additional modifications and variations would be apparent to those skilled in the art. It is therefore to be understood that the present invention may be practices otherwise than specifically described. Thus, embodiments of the present invention should be considered in all respects as illustrative and not restrictive.

Furthermore, the foregoing discussion discloses and describes merely exemplary embodiments of the present invention. One skilled in the art will readily recognize from such discussion and from the accompanying drawings that various changes, modifications and variations may be made therein without departing from the spirit and scope of the invention. Therefore, it is intended that the invention may not be limited to the particular embodiment disclosed, but that the invention.

What is claimed is:

1. A coin detection apparatus comprising:

an outer shell having dimensions that are at most 2850 MIL (thousandth of an inch) wide and 2500 MIL in height, the outer shell housing:

a coin path comprising an initial first portion starting at an opening of the coin path and that comprises a first side sloped at a first non-zero angle between 0 degrees and 90 degrees and a second side sloped at a second non-zero angle between 90 degrees and 180 degrees and such the sloped angles cause a coin to generally roll down the corresponding sides of the path and a second portion angled at a second non-zero angle and at a reverse general direction from the first portion to provide an "S" configuration, wherein each side of the second portion is sloped at a same non-zero angle and the side on which a coin generally rolls due to gravity is padded with a shock absorbent material to dampen bounce of the coin such that the reverse general direction and gravity keep the coin to one side of the second portion of the coin path as the coin travels through the coin path, wherein a width of the coin path is at most 1225 MIL wide at both a start and end of the second portion of the coin path, and a third portion of the coin path that is sloped at a 90 degree angle to cause the coin to freefall out of the coin path;

an auxiliary (AUX) interface that (1) provides wired communications to an external device and (2) obtains power from the external device, wherein an audio tone from the external device is processed through an analog circuit that treats the audio tone as a pulse width modulated (PWM) DC/DC converter to obtain power;

a network interface comprising an antenna that transmits wireless data to a software application executing on the external device; and a light emitting diode (LED) sensor array positioned at an end of the second portion of the coin path and at the side opposite the side at which the coin rolls down the coin path, wherein the LED sensor array is configured to transmit a plurality of light beams within the coin path in order to detect characteristics of coins travelling through the coin path;

a micro-controller comprising a low power embedded application that executes computer instructions;

wherein the computer instructions direct the micro-controller to:

detect characteristics including a size of a coin travelling through the coin path by determining which of the plurality of light beams of the LED sensor array are blocked by the coin as the coin travels through the coin path; and transmit from the coin detection apparatus, using at least one of the network interface, data regarding a coin type based on the detected characteristics of the coin to the software application executing on the external device.

2. The coin detection apparatus of claim 1, wherein the LED sensor array comprises a plurality of LEDs that each transmit a light beam to a corresponding light detector photodiode.

3. The coin detection apparatus of claim 1, wherein the data is transmitted using a wireless communication channel.

4. The coin detection apparatus of claim 1, wherein the data is transmitted to an input port of the external device selected from the group consisting of an auxiliary port, a microphone port, a charging input, and a data insert.

5. The coin detection apparatus of claim 1, wherein the software application executing on the external device converts the data to a coin type.

6. The coin detection apparatus of claim 1, wherein the apparatus receives power from the external device.

7. A method of identifying a coin using an array of light beams positioned within a coin detection device, the method comprising:

receive a coin within a coin path of the coin detection device, wherein the coin detection device comprises an outer shell having dimensions that are at most 2850 MIL (thousandth of an inch) wide and 2500 MIL in height, the outer shell housing the coin path that comprises an initial first portion starting at an opening of the coin path and that comprises a first side sloped at a first non-zero angle between 0 degrees and 90 degrees and a second side sloped at a second non-zero angle between 90 degrees and 180 degrees and such that the sloped angles cause the coin to generally roll down the corresponding sides of the path and a second portion angled at a second non-zero angle and at a reverse general direction from the first portion to provide an "S" configuration, wherein each side of the second portion is sloped at a same non-zero angle and the side on which the coin rolls due to gravity is padded with a shock absorbent material to dampen bounce of the coin as it moves from the first portion to the second portion and such that the reverse general direction and gravity keep the coin to one side of the second portion of the coin path as the coin travels through the coin path, wherein a width of the coin path is at most 1225 MIL wide at both a start and end of the second portion of the coin path, and a third portion of the coin path that is sloped at an angle that causes the coin to freefall out of the coin path;

transmit a plurality of light beams using a sensor array of light emitting diodes (LED) that each transmit a light beam to a corresponding light detector photodiode within the second portion of the coin path, wherein the LED sensor array is positioned at an end of the second portion of the coin path and at the side opposite the side at which the coin rolls down the coin path;

detect a size of a coin travelling through the coin path by determining which of the plurality of light beams are blocked by the coin as the coin travels through the coin path; and identify a coin type based on the size of the coin;

transmit from the coin detection device, using at least one of a network interface, data regarding the coin type based on the detected characteristics of the coin to a software application executing on an external device; and wherein the network interface comprises an antenna that transmits wireless data to the software application executing on the external device.

8. The method of claim 7, further comprising transmitting data regarding the coin type to the software application executing on the external device.

9. The method of claim 8, wherein transmitting data regarding the coin type comprises transmitting an audio frequency to the software application executing on the external device.

10. The method of claim 8, wherein the data is transmitted using a wireless communication channel.

11. The method of claim 7, wherein the data is transmitted to an input port of the external device selected from the group consisting of an auxiliary port, a microphone port, a charging input, and a data insert.

12. The method of claim 10, where the data is transmitted using a wireless communication channel selected from the group consisting of a Bluetooth connection and a wifi connection.

13. The coin detection apparatus of claim 1, wherein a size of the coin detection apparatus is at most several inches in each direction such that it can be hand-held.

14. The method of claim 7, wherein a size of the coin detection device is several inches in each direction such that it can be hand-held.

* * * * *